United States Patent [19]

Ryder

[11] Patent Number: 4,792,251

[45] Date of Patent: Dec. 20, 1988

[54] SMOOTH DRIVE LIPSTICK CONTAINER

[75] Inventor: Kenneth F. Ryder, Prospect, Conn.

[73] Assignee: Bridgeport Metal Goods Manufacturing Co., Bridgeport, Conn.

[21] Appl. No.: 849,810

[22] Filed: Apr. 9, 1986

[51] Int. Cl.[4] ..... A45D 40/06; B43K 21/08

[52] U.S. Cl. ..... 401/74; 401/78; 401/80; 401/98

[58] Field of Search ..... 401/68, 74, 75, 77, 401/78, 80, 98, 171, DIG. 1

[56] References Cited

U.S. PATENT DOCUMENTS

| | | | |
|---|---|---|---|
| D. 139,617 | 12/1944 | Rich | 401/98 |
| 1,849,531 | 3/1932 | Lyhne | 401/74 |
| 2,072,662 | 3/1937 | Abbotts | 401/74 |
| 2,332,147 | 10/1943 | Holihan | 401/74 |
| 2,352,448 | 6/1944 | Reichenbach | 401/78 |
| 2,385,680 | 9/1945 | Book | 401/74 |
| 2,840,230 | 6/1958 | Lerner | 206/56 |
| 2,921,675 | 1/1960 | Clark et al. | 401/192 |
| 3,083,822 | 4/1963 | Clark | 401/74 |
| 3,124,244 | 3/1964 | Hopgood | 401/78 |
| 3,272,327 | 9/1966 | Busch | 401/78 |
| 3,429,643 | 2/1969 | Seaver | 401/75 |
| 3,438,714 | 4/1969 | Seaver | 401/74 |
| 3,512,896 | 5/1970 | Gruska | 401/80 |
| 3,515,493 | 6/1970 | Gruska | 401/74 |
| 3,539,266 | 11/1970 | Hultgren | 401/78 |
| 4,417,827 | 11/1983 | Kasai et al. | 401/68 |
| 4,514,102 | 4/1985 | Ackerman et al. | 401/78 |
| 4,603,989 | 8/1986 | Ackerman et al. | 401/74 |
| 4,690,578 | 9/1987 | Idec et al. | 401/77 |

FOREIGN PATENT DOCUMENTS

| | | | |
|---|---|---|---|
| 2053268 | 5/1972 | Fed. Rep. of Germany | 401/78 |
| 3211065 | 11/1982 | Fed. Rep. of Germany | 401/68 |
| 1019835 | 1/1953 | France | 401/98 |
| 245224 | 10/1946 | Switzerland | 401/78 |
| 253193 | 2/1948 | Switzerland | 401/78 |
| 731013 | 6/1955 | United Kingdom | 401/98 |
| 847044 | 9/1960 | United Kingdom | 401/78 |
| 853306 | 11/1960 | United Kingdom | 401/78 |
| 1109797 | 4/1968 | United Kingdom | 401/78 |
| 1118889 | 7/1968 | United Kingdom | 401/78 |

*Primary Examiner*—Gary L. Smith
*Assistant Examiner*—Eric K. Nicholson
*Attorney, Agent, or Firm*—Kramer, Brufsky & Cifelli

[57] ABSTRACT

A lipstick container having an attractive noncircular form includes a unique operating mechanism for reciprocating a cup member adapted to hold a mass of lipstick. The operating mechanism includes a friction ring which is fitted on the outer body member whereby a constant swivel torque is required to opereate the mechanism through the length of its stroke. The friction ring creates a smoothly operating, luxurious feeling mechanism, limits relative axial movement or "shuck" between the inner and outer body members, and eliminates the need for a bottom pair of lock extension slots.

23 Claims, 1 Drawing Sheet

FIG. 1
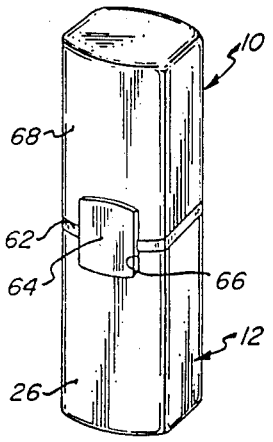
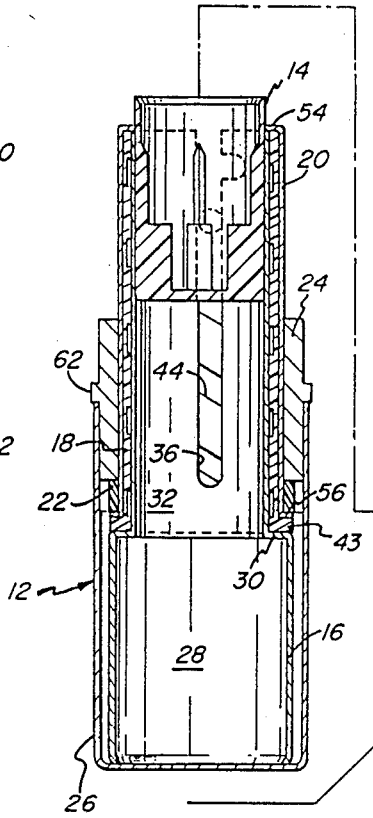
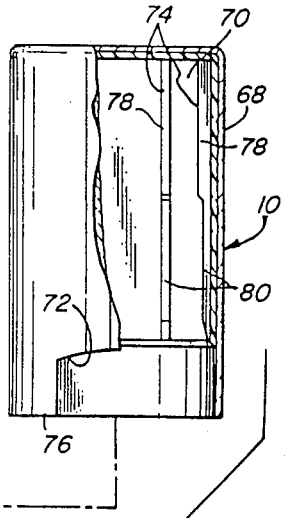
FIG. 2
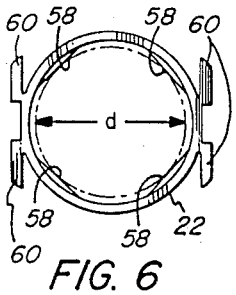
FIG. 6
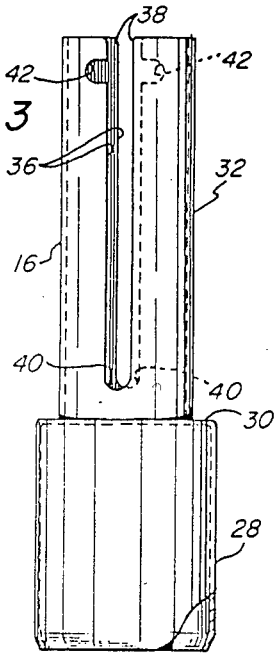
FIG. 3
FIG. 4
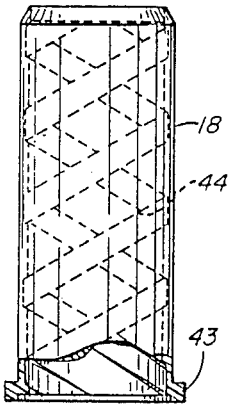
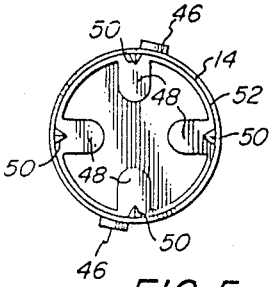
FIG. 5

SMOOTH DRIVE LIPSTICK CONTAINER

BACKGROUND OF THE INVENTION

The present invention relates generally to lipstick containers, and more particularly to lipstick containers having mechanical mechanisms for manipulating their associate lipstick masses longitudinally within the containers between extended and retracted positions.

Lipstick containers having mechanisms for manipulating their associated lipstick masses are well-known in the art. The prior art containers generally have a main inner body member having a finger engaging knob or base portion at one end thereof and a tubular sleeve portion at the other end thereof. Extending longitudinally in the tubular sleeve portion are a pair of diametrically opposed elongated slots with locking portions at their terminal ends.

Mounted within the tubular sleeve portion is a cup element adapted to receive the lipstick mass and having a pair of diametrically opposed, outwardly extending posts captured in the pair of slots in the tubular sleeve. The posts are also captured in a pair of helical or spiral grooves formed in the inner wall of an outer sleeve which surrounds the tubular sleeve of the inner body member. The inner body member and the outer sleeve are mechanically retained to one another at their upper ends by a conventional lip and groove arrangement which permits relative rotational movement therebetween.

In operation, relative rotation between the inner body member and the outer sleeve foces the captured posts of the cup member to follow both the longitudinal slots of the inner body member and the helical grooves of the outer sleeve thereby moving the cup element longitudinally in the inner body member, alternatively, between its retracted locked position completely within the inner body member and its protracted locked position extending partially outside the inner body member. In its retracted locked position, the posts of the cup member are located within the lower locking portions (adjacent the knob or base portion) of the longitudinal slots; the cup being thereby inhibited from longitudinal movement during transportation and handling of the lipstick container. In its protracted locked position, inadvertent downward movement of the cup is inhibited during both the loading of the lipstick mass into the container during the assembly process and the application of associated lipstick onto a user's lips.

One of the problems which has been encountered in the use and manufacture of such containers is wide, undesirable variations in the swivel torque required to control the relative rotation of the inner body member and the outer sleeve to drive the cup element between the retracted and protracted positions.

Swivel torque for lipstick container is generally measured in inch-ounces with the ideal range of acceptability being two (2) to six (6) inch-ounces. To achieve this range in the prior art lipstick containers, a variety of methods have been used including manufacturing the cup element to have an outer diameter slightly larger than the inner diameter of the main body member whereby the cup member tends to resist longitudinal movement within the inner body member. In practice, due to manufacturing inaccuracies, such as encountering nonuniform inner diameters of the main body member as the cup element moves axially therethrough, the swivel torque found in the prior art devices tends to range from one (1) to thirteen (13) inch-ounces and can vary dramatically over the stroke of the cup element between its retracted and protracted positions. Oftentimes, the containers with swivel torques at the upper end of this range are nearly inoperable and must be rejected and discarded as having unacceptably high swivel torques. Other prior art methods for controlling swivel torque include providing an interference fit between the outer sleeve and the inner body member either along the entire adjacent peripheries thereof or solely at the upper ends thereof. However, these methods have proved equally unsuccessful for producing mass production containers which fall within the ideal range of swivel torque acceptability.

Another undesirable feature of the prior art designs, is the presence of unwanted longitudinal movement or "shuck" between the inner body member and the outer sleeve. Such "shuck" can be attributed to manufacturing tolerances and the type of connection (lip and groove) utilized between the inner body member and the outer sleeve.

The present invention is designed to overcome the above-noted limitations, and toward this end, it contemplates the provision of a novel lipstick container which can be manufactured on a high volume basis and consistently fall within the ideal range of swivel torque.

It is an object to provide such a lipstick container which has a uniform swivel torque throughout the length of its stroke thereby creating an ultrasmooth operating mechanism.

Still another object is to provide such a lipstick container which eliminates relative longitudinal movement or "shuck" between its inner body member and outer sleeve.

A further object is to provide such a container which may be readily fabricated and will enjoy long life in operation.

SUMMARY OF THE INVENTION

It has now been found that the foregoing and related objects can be readily attained in a lipstick container comprising an inner body member having a lower enlarged knob portion and an upper tubular portion with a shoulder therebetween. The tubular portion has a pair of diametrically opposed, longitudinally extending slots formed therethrough. A spiral body member, including a pair of intertwined spiral grooves on its interior surface adjacent the tubular portion, at least partially surrounds the tubular portion of the inner body and seats on the shoulder for relative rotation thereabout. An outer body member is concentrically mounted on the spiral body member for rotation therewith. A friction ring surrounds the outer body member and provides a radially inward force thereon while a center band surrounds the outer body member upwardly adjacent the friction ring. A slideable cup, adapted to carry a lipstick mass, is received in the upper tubular portion of the inner body member and has a pair of diametrically opposed posts extending through the longitudinal slots in the tubular portion and into the spiral grooves in the spiral body member. A cup-shaped base cap is force fit over the lower knob portion of the inner body member and extends over the friction ring and is force fit on the center band whereby the base cap holds the slideable cup, inner body member, spiral body member, outer body member, friction ring and center band in assembly. Furthermore, the base cap, inner body member, friction ring and center band are rotatable together as a unitary structure with respect to the spiral body member and outer body member. Accordingly, relative rotation between the inner body member and the spiral body member moves the slideable cup between a protracted position and a retracted position.

Desirably, the spiral body member has an outwardly, extending flange at a lower end thereof seated on the shoulder of the inner body member. Seated on the flange of the spiral body member is the outer body member which also has an outwardly, extending flange at its lower end upon which the friction ring is seated. The friction ring has at least one pair of opposed land surfaces on an inside circumference thereof creating an interference-fit relationship between the friction ring and the outer body member.

Conveniently, a protective cover is releasably engaged with the outer body member and removably positioned over at least a portion of the center band. The cover has an insert therein for holding the cover and the outer body member in assembly when the cover is fully seated on the outer body member. The cover, center band and outer body member are cooperatively dimensioned so that the cover is removably positioned over the center band whenever the cover is releasably engaged with the outer body member.

The invention will be more fully understood when reference is made to the following detailed description taken in conjunction with the accompanying drawing.

BRIEF DESCRIPTION OF THE DRAWINGS

FIG. 1 is a perspective view of a lipstick container according to the invention herein;

FIG. 2 is an enlarged exploded view of the lipstick container of FIG. 1 with the protective cover assembly broken away and the main body assembly in cross section;

FIG. 3 is an enlarged side view of the inner body member with a portion broken away for illustrative purposes;

FIG. 4 is an enlarged side view of the spiral body member with a portion broken away to illustrate internal structure;

FIG. 5 is an enlarged top view of the cup member; and

FIG. 6 is an enlarged top view of the friction ring.

The same reference numerals refer to the same elements throughout the various Figures.

DETAILED DESCRIPTION OF THE PREFERRED EMBODIMENT

Referring first to FIG. 1, therein is illustrated a lipstick container according to the invention herein and generally comprising two main assemblies which are a protective cover assembly 10 and a main body assembly 12. As can be appreciated from FIG. 1, the lipstock container has an attractive noncircular configuration.

Turning now to FIG. 2, the main body assembly 12 comprises a cup member 14, an inner tubular body member 16, a spiral body member 18, an outer body member 20, a friction ring 22, a noncircular cast metal, plated center band 24 and noncircular base cap 26. The inner body member 16 illustrated in detail in FIG. 3 is prepared from a steel material in an overall generally circular configuration and has an enlarged base or knob portion 28, open at its lower end, with a shoulder 30 on its upper end from which extends an upper reduced dimensioned tubular sleeve portion 32. Formed within the upper portion 32 are a pair of diametrically opposed, longitudinally extending slots 36 open at their upper ends as indicated by numeral 38 and terminating short of shoulder 30 at their lower terminal ends as indicated by numberal 40. The slots 36 include upper lock extension portions 42 which are diametrically opposed and extend in a circumferential direction.

Referring now to FIGS. 2 and 4, the spiral body member 18, molded from a plastic material to have a circular configuration, is concentrically mounted about the upper reduced dimensioned portion 32 whereby the spiral body member 18 and the inner body member 16 are relatively rotatable with respect to one another. The spiral body member 18 has a radially outwardly extending flange 43 which is seated on the shoulder 30 of the inner body member 16. As best seen in FIG. 4, on the inner surface of the spiral body member 18 is a pair of intertwined spiral grooves or tracks 44 which terminate short of the ends of the spiral body member 16.

Mounted for longitudinal sliding movement within the inner body member 16 is the cup member 14 which molded from a plastic material such as Delrin Dupont 900 and has a pair of diametrically opposed, outwardly directed posts 46 (note FIG. 5) extending through the slots 36 of the inner body member 16 and captured in the spiral tracks 44 of the spiral body member 18. Thus, as should be understood by those skilled in the art, relative rotation between the inner body member 16 and the spiral body member 18 causes the posts 46 to follow both the spiral tracks 44 and the longitudinal slots 36 thereby raising or lowering the cup member according to the direction of rotation. As shown in FIG. 5, the cup member 14 has four semicircular shaped extensions 48 upon which a lipstick mass (not shown) can be seated. Four ribs 50 project inwardly from side wall 52 and aid in retaining a lipstick mass in position.

Referring again to FIG. 2, the outer body member 20 is made of brass and surrounds the spiral body member 18 thereby providing a decorative cover therefor. The upper end of the outer body member 20 has an inwardly directed lip 54 covering the terminal end of the spiral body member 18 whereas the bottom end has an outwardly directed lip 56 which is seated on the flange 43 of the spiral body member 18. It should be understood that the spiral body member 18 and the outer body member 20 are rotatable together and this two-piece structure can be termed an outer sleeve. It is contemplated by this invention that the outer sleeve can be a two-piece structure as shown or, alternatively, a one-piece structure.

Inserted over the outer body member 20 and seated on its outwardly directed lip 56 is the friction ring 22 which is molded from thermoplastic such as polyethylene. As best seen in FIG. 6, the friction ring 22 has two pairs of opposed flat land surfaces 58 along its inner circumference and two pairs of outwardly extending feet 60 on its outer circumference. The working diameter of the friction ring 22, indicated by the letter d, which is the distance between the opposed land surfaces 58, is less than the diameter of the outer body member 20 and, accordingly, when the friction ring 22 is assembled on the outer body member 20, it achieves a friction-fit or interference-fit relationship therewith at the land surface 58. In the preferred embodiment, the distance between the opposed land surfaces 58 is approximately six hundred forty-nine thousandths of an inch (0.649") while the outer diameter of outer body member 20 is approximately six hundred fifty-five thousandths of an inch (0.655"). Accordingly, the friction ring 22 achieves a snug fit on the outer body member 20 such that relative rotation therebetween is permitted at a controlled force.

The noncircular cast metal, plated center band 24, with its bead portion 62 and emblem portion 64 (See FIG. 1), surrounds the outer body member 20 upwardly adjacent of the friction ring 22. The purpose of the emblem portion 64 is to provide an area for an appropriate decorative design.

To maintain all the components of the main body assembly 12 in assembly, a force fit is achieved between the center band 24 and the noncircular base cap 26 which has a cutout 66 (FIG. 1) to accommodate the emblem portion 64 and is made of copper plated steel. It should be understood that the feet 60 of the friction ring 22 fit snuggly within the base cap 26, which is in abutting relationship with bead 62 and is force fit on the enlarged base portion 28 of the inner body member 16, whereby the inner body member 16, base cup 26, center band 24 and friction ring 22 are rotatable as a unitary structure relative to the spiral body member 18 and the outer body member 20.

The protective cover assembly 10 has a noncircular end cap 68, identical to the base cap 26, and a plastic cap liner 70 inserted therein. The end cap 68 includes a cutout 72 to accommodate emblem portion 64 while the cap liner 70 has a plurality of inwardly directed ribs 74 (only two shown) whereby the assembly 10 is dimensioned to be insertable over and to be releasably retainable on the outer body member 20. However, it should be appreciated that the protective cover assembly 10 is carefully designed with the ribs 74 of the cap liner 70 having a stepped configuration so that the lower end 76 of the end cap 68 must be positioned about the noncircular center band prior to the ribs 74 releasably retaining the cap assembly 10 on the outer body member 20, i. e., the ribs 74 have upper portions 78 which cooperate for releasable retention purposes while lower portions 80 are provided solely for guidance purposes and do not perform a retaining function. Accordingly, this design prevents inadvertent relative rotation of the components of the main body assembly 12 during removal and replacement of the protective cover assembly 10 thereon as the protective cover assembly 10 cannot be rotated relative to the main body assembly 12 when the ribs 74 releasably retain it on the outer body member 20. If such inadvertent relative rotation were permitted, it would be possible for a retracted associated lipstick mass (not shown) carried by the slideable cup 14 to move upwardly into engagement with the cover assembly 10 with disastrous results during removal and replacement thereof.

In using the container with the protective cover 10 of the lipstick container removed as shown in FIG. 2, the user can grasp the outer body 20 and the base cup 26. By providing a relative rotational force on the outer body 20 and the base cap 26, the inner body 16 rotates relative to the spiral body member 18 causing the cup member 14 to move longitudinally therewithin until the posts thereof reach their lower limit defined by the lower terminal ends 40 of the slots 36 or their upper limit defined by the lock portions 42 depending on the direction of the rotational force. The interference fit between land surfaces 58 of the friction ring 22 and the outer body member 20 provide a constant radial force on the outer body member 20 whereby a constant swivel torque of approximately two (2) to six (6) inch-ounces is required to move the cup member 14 longitudinally between its two limit positions thereby producing a luxurious feeling, smoothly operating mechanism for the user of the container. The container 10 of the present invention relieves the manufacturer from many of the manufacturing tolerance variations attendant in the prior art containers in that the present container can be readily mass produced and still fall consistently within the ideal range of swivel torque. The friction ring 22 also eliminates the need for a lower or bottom lock portions normally found in prior art containers whereby the constant force on the outer ring prevents inadvertent movement of the cup member 14 from its lower retracted position during transportation and handling thereof. It should be appreciated that the overall assembly of the present container also limits undesirable "shuck" or limited axial movement of the outer body member 20 and the spiral body member 18 relative to the other components as the force-fit relationship between the center band 24 and the base cap 26 holds the components in relatively tight assembly.

From the foregoing description of the invention and the discussion of the prior art, the numerous advantages and improvements incident to this invention will now be apparent to those skilled in the art.

Accordingly, the above description of the invention is to be construed as illustrative only rather than limiting. The invention is limited only by the scope of the following claims.

Having thus described the invention, I claim:

1. A lipstick container comprising:

(a) a metal inner body member having a lower knob portion and an upper tubular portion;

(i) said tubuar portion having at least one longitudinally extending slot formed therethrough;

(b) an outer sleeve at least partially surrounding said tubular portion of said inner body member and mounted thereon for relative rotation thereabout;

(i) said outer sleeve having at least one spiral groove on its interior surface adjacent said tubular portion;

(ii) said outer sleeve having an outwardly, extending flange at one end thereof;

(c) friction ring means seated on said external flange, said ring means having an inner circumference engaging at least a portion of an outer surface of said outer sleeve and operatively connected between said inner body member and said outer sleeve, said inner cirumference being slightly less than the outer circumference of said outer sleeve to achieve an interference fit for providing a radial force on the outer sleeve whereby an approximately constant torque is required to enable relative rotation therebetween;

(d) a slideable cup adapted to carry a lipstick mass, said cup received in said tubular portion and having at least one post extending through said at least one longitudinal slot in said tubular portion and into said at least one spiral groove in said outer sleeve whereby relative rotation between said inner body member and said outer sleeve moves said slideable cup between a protracted position and a retracted position; and two pairs of outwardly extending feet on the outer circumference of said friction ring means for operatively connecting said inner body member and said outer sleeve.

2. The lipstick container in accordance with claim 1 wherein said friction means has at least one pair of opposed land surfaces on an inside surface thereof creating an interference-fit relationship between said friction means and said outer sleeve.

3. The lipstick container in accordance with claim 2 wherein said friction means surrounds at least an axial portion of said outer sleeve.

4. The lipstick container in accordance with claim 3 wherein said outer sleeve has an outwardly, extending flange at a lower end thereof and said friction means is seated on said flange.

5. The lipstick container in accordance with claim 1 wherein said outer sleeve includes an spiral body member and an outer body member thereover.

6. The lipstick container in accordance with claim 5 wherein said outer body member has an outwardly, extending flange at a lower end thereof upon which said friction means is seated.

7. The lipstick container in accordance with claim 1 further including a cover removably positioned over said outer sleeve, said cover having an insert therein for holding said cover and said outer sleeve in assembly when said insert is fully seated on said outer sleeve.

8. The lipstick container of claim 1 wherein said friction ring means include at least one pair of opposed flat land surfaces along its inner circumference, the distance between the opposed land surfaces being less than the diameter of the outer sleeve.

9. The lipstick container of claim 8 wherein said friction ring means is plastic.

10. The lipstick container in accordance with claim 1 further including a center band surrounding said outer body member and being adjacent said friction means.

11. A lipstick container comprising:

(a) an inner body member having a lower enlarged knob portion and an upper tubular portion with a shoulder therebetween;

(i) said tubular portion having a pair of diametrically opposed, longitudinally extending slots formed therethrough;

(b) a spiral body member at least partially surrounding said tubular poriton of said inner body and seated on said shoulder for relative rotation thereabout, said spiral body member having a pair of spiral grooves on its interior surface adjacent said tubular portion;

(c) an outer body member concentrically mounted on said spiral body member for rotation therewith;

(d) a friction ring having an inner circumference surrounding and slidably engaging an axial portion of an outside surface of said outer body member, said inner circumference being slight less than the outer circumference of said outer body member to achieve an interference fit with said outer body member and providing a radially inward force thereon;

(e) a center band surrounding an axial portion of the outside surface of said outer body member adjacent said friction ring;

(f) a slideable cup adapted to carry a lipstick mass, said cup received in said tubular portion and having a pair of diametrically opposed posts extending through said longitudinal slots in said tubular portion and into said spiral grooves in said spiral body member;

(g) a cup-shaped base cap force fit on said lower knob portion of said inner body member and extending over said friction ring and being force fit on said center band whereby said base cap holds said slideable cup, inner body member, spiral body member, outer body member, friction ring and center band in assembly and said base cap, inner body member, friction ring and center band are rotatable together as a unitary structure with respect to said spiral body member and outer body member, and whereby relative rotation between said inner body member and said spiral body member moves said slideable cup between a protracted position and a retracted postion; and two pairs of outwardly extending feet on the outer circumference of said friction ring means for snugly fitting between said base cap and said outer sleeve to operatively connect said inner body member and said outer sleeve.

12. The lipstick container in accordance with claim 11 wherein said friction ring has at least one pair of opposed land surfaces on an inside surface thereof creating an interference-fit relationship between said friction ring and said outer body member.

13. The lipstick container in accordance with claim 11 further including a cover removably positioned over said outer body member, said cover having an insert therein for holding said cover and said outer body member in assembly when said insert is fully seated on said outer body member.

14. The lipstick container in accordance with claim 13 wherein said cover and said base cap have identical noncircular configurations.

15. The lipstick container of claim 11 wherein said friction ring means is plastic and said inner body member is metal.

16. A lipstick container comprising:

(a) an inner body member having a lower enlarged knob portion and an upper tubular portion with a shoulder therebetween;

(i) said tubular portion having a pair of diametrically opposed, longitudinally extending slots formed therethrough;

(b) an outer sleeve at least partially surrounding said tubular portion of said inner body and seated on said shoulder for relative rotation thereabout, said outer sleeve having a pair of spiral grooves on its interior surface adjacent said tubular portion;

(c) a slideable cup adapted to carry a lipstick mass, said cup received in said tubular portion and having a pair of diametrically opposed posts extending through said longitudinal slots in said tubular portion and into said spiral grooves in said sleeve; whereby relative rotation between said inner body member and said outer sleeve moves and slideable cup between a protracted position and a retracted position;

(d) means operatively connected to said inner body member for rotation therewith for providing a seat for a protective cover;

(e) a protective cover dimensioned to be releasably engaged with said outer sleeve and removably positioned over at least a portion of said seat means; said cover being dimensioned with respect to said outer sleeve and said seat means so that said cover is removably positioned over said seat means whenever said cover is releasably engaged with said outer sleeve;

(f) friction ring means having an inner circumference surrounding an axial poriton of an outside surface of said outer sleeve and operatively connected between said inner body member and said outer sleeve, said inner circumference being slightly less than the outer circumference of said outer sleeve to achieve an interference fit for providing a radial force to inhibit relative rotation therebetween; and two pairs of outwardly extending feet on the outer circumference of said friction ring means for operatively connecting said inner body member and said outer sleeve.

17. The lipstick container in accordance with claim 16 wherein said protective cover includes an end cap having an opening at one end thereof and an insert therein terminating short of said one end, said insert comprising means releasably engaging said outer sleeve.

18. The lipstick container of claim 16 wherein said friction ring means is plastic and said inner body member is metal.

19. A lipstick continer comprising:

(a) an inner body member having a lower knob portion and an upper tubular portion;

(i) said tubular portion having at least one longitudinally extending slot formed therethrough;

(b) an outer sleeve at least partially surrounding said tubular portion of said inner body and mounted thereon for relative rotation thereabout;

(i) said outer sleeve having at least one spiral groove on its interior surface adjacent said tubular portion;

(c) friction ring means having an inner circumference surrounding an axial portion of an outside surface of said outer sleeve and operatively connected between said inner body member and said outer sleeve, said inner circumference being slightly less than the outer circumference of said outer sleeve to achieve an interference fit with said outer sleeve for providing a radial force to inhibit relative rotation therebetween;

(d) a slideable cup adapted to carry a lipstick mass, said cup receiving in said tubular portion and having at least one post extending through said at least one longitudinal slot in said tubular portion and into said at least one spiral groove in said sleeve; whereby relative rotation between said inner body member and said outer sleeve moves said slideable cup between a protracted position and a retracted position;

(e) a center band surrounding an axial portion of the outside surface of said outer sleeve and being upwardly adjacent said friction ring means; and two pairs of outwardly extending feet on the outer circumference of said friction ring means for operatively connecting said inner body member and said outer sleeve.

20. The lipstick container in accordance with claim 19 wherein said outer sleeve includes a spiral body member and an outer body member thereover.

21. The lipstick container in accordance with claim 20 further including a cup-shaped base cap force fit on said knob portion of said inner body member and extending over said friction means and being force fit on said center band whereby said base cap holds said inner body, outer sleeve, friction means, slideable cup and center band in assembly and said base cap, inner body member, friction means and center band are rotatable together as a unitary structure.

22. The lipstick container in accordance with claim 21 further including a cover removably positioned over said outer sleeve, said cover and said base cap have identical noncircular configurations.

23. The lipstick container of claim 19 wherein said friction ring means is plastic and said inner body member is metal.

* * * * *